United States Patent [19]

Takasaki

[11] 4,065,179

[45] Dec. 27, 1977

[54] NURSING CARRIAGE

[76] Inventor: Takao Takasaki, No. 4920-2, Ooazahirano, Nichinan, Miyazaki, Japan

[21] Appl. No.: 743,599

[22] Filed: Nov. 22, 1976

[30] Foreign Application Priority Data

Nov. 27, 1975 Japan ..... 50-124737

[51] Int. Cl.[2] ..... A61G 1/02

[52] U.S. Cl. ..... 297/384; 297/DIG. 4; 5/86

[58] Field of Search ..... 297/16, 335, 384, DIG. 4; 5/86, 81

[56] References Cited

U.S. PATENT DOCUMENTS

| | | | |
|---|---|---|---|
| 2,806,511 | 9/1957 | Merelis | 297/335 X |
| 2,854,673 | 10/1958 | Ramsey | 5/86 |
| 3,409,326 | 11/1968 | Kerner | 297/384 |
| 3,629,880 | 12/1971 | van Rhyn | 297/DIG. 4 |
| 3,761,126 | 9/1973 | Mulholland | 297/384 |
| 3,938,820 | 2/1976 | Nabinger | 5/86 |

*Primary Examiner*—Francis K. Zugel

[57] ABSTRACT

A nursing carriage for supporting a body of an infant or a disabled person, having a base frame with casters, the body frame erected on the base frame, and a top frame fixedly mounted on the body frame. The carriage has a pair of embracing arms swingably supported on the body frame. The embracing arms can be locked in their respective embracing positions and have holding members which are displaceable inwardly upon application of a weight on the embracing arms to embrace securely the body of a baby or disabled person under his or her arms. The carriage further includes a seat swingably mounted on the body frame and centrally has an opening to allow the baby or disabled person to make discharges in the sitting position.

11 Claims, 6 Drawing Figures

NURSING CARRIAGE

BACKGROUND OF THE INVENTION

This invention relates to a nursing aid, and more particularly to a nursing carriage which is adapted to support embracingly the body of an infant while changing diapers or during excretion or of a person who has lost freedom of movement due to senility or sickness.

Generally, it is easy to change, a baby's diapers or napkin when she or he is very young and lies on her or his back obediently without crawling around. However, as the baby grows up, she or he sometimes becomes fretful and resists with a greater force to make it diffucult to hold the baby's body while changing diapers. In addition, the one who takes care of a baby has to hold her or his body for a relatively long time during excretion.

The nursing requires more efforts when it comes to a grown-up disabled person who has a greater weight, and can be a great burden to a nurse who has to support the body of the disabled person while taking baths or meals or ejecting excrements.

The present invention has as its object the provision of the nursing apparatus which holds a body of an infant or disabled person safely and securely to lessen the burden of the nurse or the one who takes care of the baby or the disabled person.

It is another object of the present invention to provide a nursing apparatus which is provided with a pair of holding arms which embrace a baby or disabled person under his or her arms stably with a variable force depending upon the weight of the person to be carried.

It is still another object of the present invention to provide a nursing apparatus which is collapsible into a flat shape to receive a person lying on a bed and shiftable to carry and hold the person in an upright position.

SUMMARY OF THE INVENTION

According to the persent invention, there is provided a nursing carriage comprising in combination: a base frame having a pair of substantially parallel extending feet, each with a caster at the toe and heel ends thereof; a body frame having a substantially rectangular shape and erected on the base frame in a slightly reclined position; a T-shaped support securely mounted on the body frame and having a vertical column and a transverse beam; a seat swingably mounted on the vertical column of the T-shaped support; a pair of embracing arms swingably mounted on the transverse beam of the T-shaped support; an arm operating mechanism having means for locking their embracing arms in the respective embracing positions and means for displacing the embracing arms toward each other upon application of a weight thereon; a top frame mounted securely on the body frame at a position above the embracing arms; side frames attached at opposite sides of the body frame; and auxiliary legs swingably mounted on side frames.

The above and other objects, features and advantages of the invention will become apparent from the following particular description of the invention and the appended claims, taken in conjunction with the accompanying drawings.

DETAILED DESCRIPTION OF THE PREFERRED EMBODIMENTS

Figure 1:
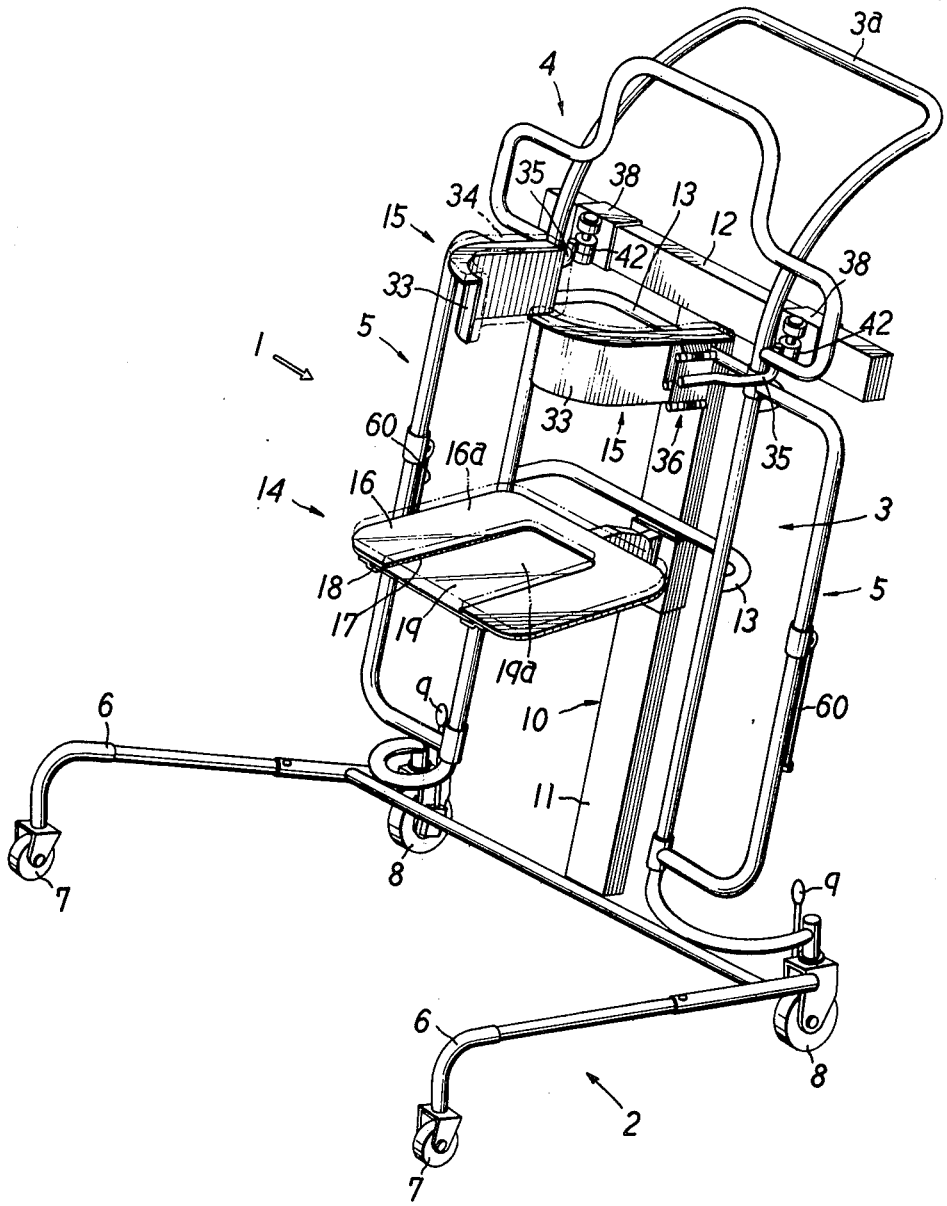
FIG. 1 is a perspective view of a nursing carriage according to the present invention.
Figure 2:
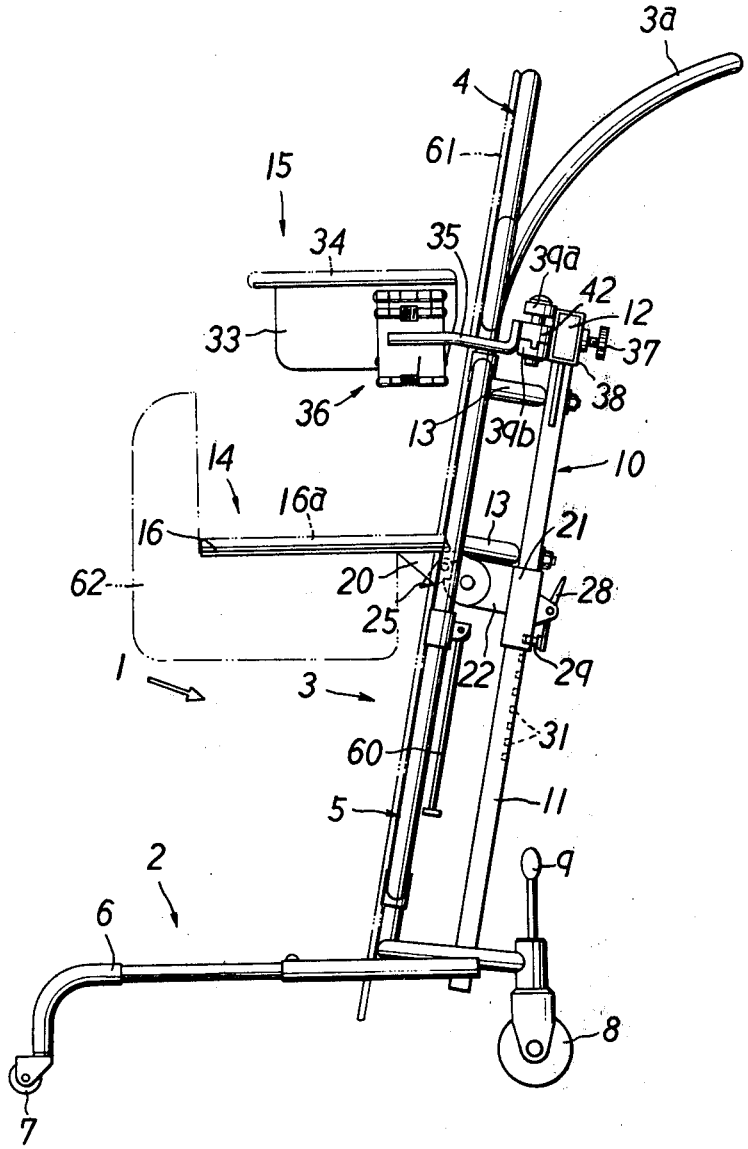
FIG. 2 is a side elevation of the nursing carriage of FIG. 1

Referring to the accompanying drawings, and first to FIGS. 1 and 2, the nursing carriage according to the invention has a framework 1 of round pipes, including a base frame 2, a body frame 3 erected on the base frame 2, and a top frame 4 and side frames 5 which are attached to the upper portion and opposite sides of the body frame 3, respectively. The base frame 2 has L-shaped feet 6 at opposite sides thereof, each with a caster 7 at the toe end. The feet 6 telescopically extensible and preferably, may be locked in the extended position. The body frame 3 is securely mounted on the base frame 2 in a slightly reclined position, and has at the rearwardly curved, uppermost end a transverse frame 3*a* which serves as a handle. The lower ends of the body frame 3 are bent outwardly and securely connected to the heel ends of the feet 6, which are provided with casters 8, each with a braking mechanism which is actuated by a lever 9.

The body frame 3 has rearwardly projecting transverse pipes 13 for securely mounting thereon a T-shaped support 10 having a vertical column 11 and a transverse beam 12. The vertical column 11 of the support 10 mounts thereon a seat 14 which has a flat seat plate 16 with an opening 17 formed centrally to serve also as a commode seat. The opening 17 is normally closed by an auxiliary plate 19 which is detachably in engagement with grooves 18 formed around the marginal edges around the opening 17 of the seat plate 16. A cushion, for example, of sponge with a synthetic resin sheet cover, is removably placed on top of the seat plate 16 and the auxiliary plate 19. The transverse beam 12 of the support 10 swingably mounts thereon a pair of holding arms 15.

Figure 3:
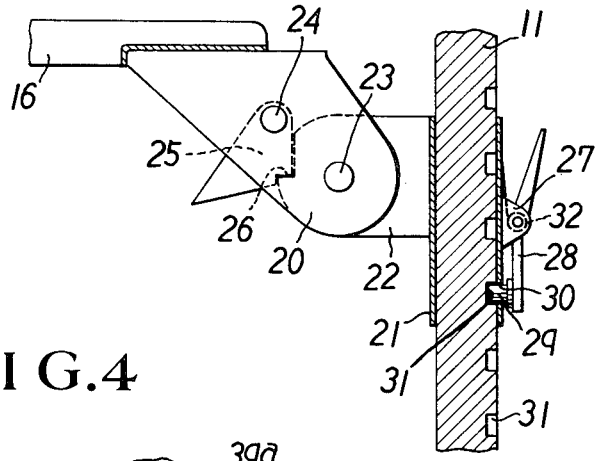
FIG. 3 is a diagrammatic view of a seat assembly.

The seat plate 16 has securely fixed to the underside thereof brackets 20 which are pivotally connected through a pin 23 to brackets 22 of a support sleeve 21 which is vertically movably fitted on the column 11, allowing the seat 14 to swing toward the body frame 3 from the horizontal position of FIG. 3. The brackets 20 of the seat plate 16 have a pin 24 and pivotally support thereon a locking claw 25 which locks the seat 14 in the horizontal position by engagement with a stopper 26 which is mounted opposingly on the brackets 22.

The support sleeve 21 has on the back side thereof a pair of brackets 27 on which a locking lever 28 is pivotally mounted through a pin. The locking lever 28 has a locking projection 29 at the lower end thereof for engagement through an aperture 30 in the sleeve 21 with one of locking grooves 31 which are provided on the back side of the column 11 at suitable intervals along the length thereof, for locking the support sleeve 21 at a desired level on the column 11. The locking lever 28 is loaded with a spring 32 to hold the locking projection 29 securely in engagement with the locking aperture 30 and grooves 31. The height of the seat 14 can thus be varied as desired by shifting the position of the support sleeve 21 on the vertical column 11.

Figure 4:
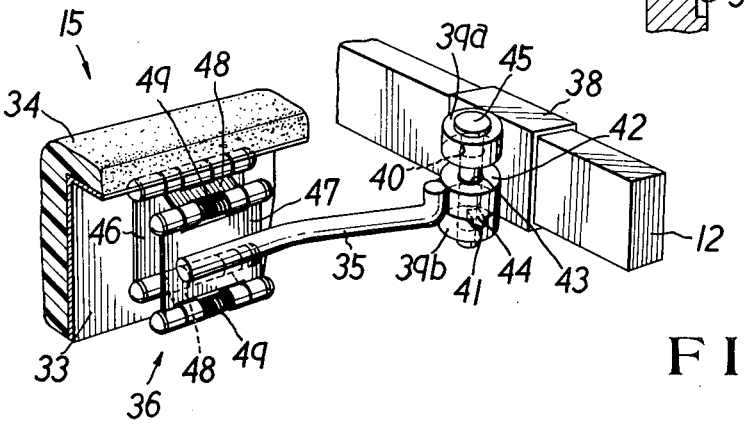
FIG. 4 is a diagrammatic view of an embracing mechanism.

The holding arms 15 which are swingably mounted on the transverse beam 12 are covered on its upper and inner sides with soft cushioning material 34, for example, sponge wrapped in a flexible sheet such as of synthetic resin. The holding arms 15 have embracing members 33 which are curved inwardly at the fore ends thereof and connected at the rear ends to the transverse beam 12 through connecting rods 35. The rear ends of the connecting rods 35 are supported on sleeves 38 which are fit on the transverse beam 12. The sleeves 38 are normally fixed on the beam 12 by bolts 37 but they are shiftable along the beam 12 toward or away from each other by loosening bolts 37 to adjust the distance between the two holding arms 15. The sleeve 38 which supports the rear end of the connecting rod 35 is provided with a pair of vertically spaced brackets 39*a* and 39*b*, each with a bore 40 as shown in FIG. 4. The connecting rod 35 has an annular joint member 42 at the rear end, the joint member 42 having a bore 43 coaxially aligned with the bores 40 of the brackets 39*a* and 39*b*. The joint member 42 is provided with a radial projection 44 on the underside thereof for engagement with a radial groove 41 on the upper side of the bracket 39*a* to stop the holding arm 15 at suitable angles. The joint member 42 is movable along and at the same time rotatable about a pin 45 which is fixedly supported at opposite ends in bores 40 of the brackets 39*a* and 39*b*.

The fore end of the connecting rod 35 is provided with a fixed connecting strip 47, the upper and lower ends of which are swingably connected to a fixed connecting strip 46 on the holding arm 33 through connecting members 48 hinged on pins at the upper and lower ends of the connecting strips 46 and 47. The holding arm 33 is constantly urged upward by coil springs 49 which are mounted on the pins at the upper and lower ends of the connecting strip 47. As the holding arm 3 is pushed down by the weight of a baby or disabled person, the connecting members 48 are turned downwardly about the pins on the connecting strip 47, displacing the arms 33 inwardly toward each other to embrace the baby or disabled person securely under her or his arms. The embracing force of the arms 33 is determined by the springs 49.

Figure 6:
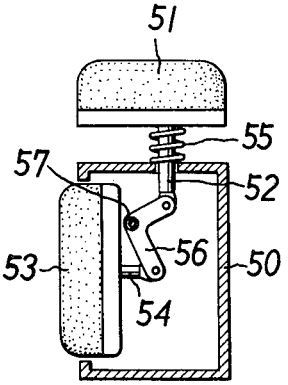
FIGS. 5 and 6 are a side elevation and a sectional view respectively illustrating a modification of the embracing mechanism.
Figure 5:
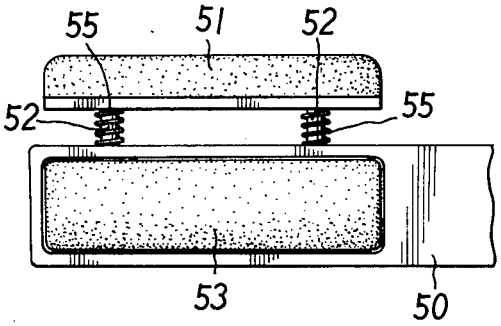

FIGS. 5 and 6 show a modification of the arm operating mechanism, wherein the embracing arm has a box-like structure 50, an arm rest 51 and a holding member 53 which is mounted in an opening formed in an inner side wall of the box-like structure 50. The arm rest 51 is mounted vertically movably on the box-like structure 50 by a number of upright shafts 52. The lower end of each shaft 52 is extended into the box-like structure 50 and pivotally connected to one hand of an L-shaped link 56 which is pivotally supported at its elbow on a pin 57. The other hand of the L-link 56 is pivotally connected to a connecting strip fixed on the back side of the holding member 53. A coil spring 55 is interposed between the arm rest and the top wall surface of the arm 50 to urge the arm rest 51 upwardly. When the arm rest 51 is pushed down by the weight of the baby or disabled person against the action of the spring 55, the L-link 56 is rotated about the axis 57 to project the holding member 53, thereby securely embracing the baby or disabled person securely under his or her arms. In this instance, the embracing force of the arm 50 is determined by the strength of the springs 55.

The afore-mentioned side frames 5 are provided with auxiliary legs 60 at median points between their upper and lower ends. The auxiliary leg 60 is swingably supported at its upper end on a bracket which is fixed on the side frame 5. The auxiliary legs 60 are swung out to support the carriage in cooperation with the rear casters 8 and the top handle 3*a* of the body frame 3 when the carriage is laid down on its back. The openings defined by the body frame 3, top frame 4 and side frames 5 are covered with panels 61 which are preferred to have cushioning material on the front sides, such as sponge wrapped in synthetic resin sheet cover.

In order to use the nursing carriage for changing diapers of a baby, the carriage is laid down on its back and the holding arms 14 which have been adjusted to suitably spaced positions are swung apart. After throwing down the seat plate 16 flat on the body frame, a baby is laid on the panel 61 and the holding arms 14 are swung inwardly into the embracing positions to hold the baby under his or her arms by the holding members 33. As the carriage is raised to the upright position, the holding members 33 are displaced inwardly by the weight of the baby to embrace his or her body securely. Under these circumstances, it is easy to change the diapers as the baby who is carried under his or her arms cannot move violently.

If it is desired to let a baby or a disabled person sit on the seat 14, the seat plate 16 is swung out and locked in the horizontal position. To allow the baby or disabled person to make discharges in the sitting position, the auxiliary plate 19 and the cushion 19*a* are removed and a commode 62 is placed under the seat plate 16. In this connection, it is preferred to provide on the seat plate 16 means for detachably mounting the commode 62.

When throwing down or raising the carriage, it is preferred to apply brakes on the rear casters 8 to ensure facilitated and safe operation.

What is claimed is:

1. A nursing carriage comprising in combination:

a base frame having a pair of substantially parallel extending feet, each with a caster at the toe and heel ends thereof;

a body frame having a substantially rectangular shape and erected on said base frame in a slightly reclined position;

a T-shaped support securely mounted on said body frame and having a vertical column and a transverse beam;

a seat swingably mounted on said vertical column of said T-shaped support;

a pair of embracing arms swingably mounted on said transverse beam of said T-shaped support;

an arm operating mechanism having means for locking said embracing arms in embracing positions and means for displacing said embracing arms toward each other upon application of a weight thereon;

a top frame mounted securely on said body frame at a position above said embracing arms;

side frames attached at opposite sides of said body frame; and auxiliary legs swingably mounted on said said frames.

2. A nursing carriage as defined in claim 1, wherein each one of said feet consists of a number of telescopically connected pipes.

3. A nursing carriage as defined in claim 1, wherein said seat is supported on a sleeve shiftably fit on said vertical column.

4. A nursing carriage as defined in claim 3, wherein said seat has a bracket on the underside thereof, said bracket being pivotally supported on said sleeve and pivotally supporting thereon a locking member for engagement with a stopper on said sleeve to lock said seat in a horizontal position.

5. A nursing carriage as defined in claim 4, wherein said seat centrally has an opening which is normally closed by an auxiliary plate.

6. A nursing carriage as defined in claim 5, wherein said seat has a cushion removably mounted thereon.

7. A nursing carriage as defined in claim 1, wherein each one of said embracing arms is swingably supported on said transverse beam through a connecting rod and a sleeve shiftably fit on said transverse beam, said connecting rod having at the rear end thereof an annular joint member pivotally supported on a bracket on said sleeve of said beam, said joint member having a locking projection for locking said arm in an embracing position by engagement with a groove on said bracket of said sleeve.

8. A nursing carriage as defined in claim 7, wherein said connecting rod is provided at the fore end thereof with a fixed connecting strip hingedly connected to a second fixed connecting strip on said embracing arm, said second fixed connecting strip being constantly urged upwardly by spring means.

9. A nursing carriage as defined in claim 8, wherein said embracing arms are covered with cushioning material at least on the upper and inner sides thereof.

10. A nursing carriage as defined in claim 1, wherein openings defined by said body frame, top frame and side frames are closed by panels covered with cushioning material at least on the front sides thereof.

11. A nursing carriage as defined in claim 7, wherein said embracing arm has a box-like structure and comprises an arm rest mounted on top of an upright shaft extending through an upper wall of said box-like structure, and a holding member mounted within an opening in an inner side wall of said box-like structure and connected to the lower end of said upright shaft through an L-shaped link pivotally supported at the elbow thereof within said box-like structure, said arm rest being constantly urged upwardly by spring means.

* * * * *

UNITED STATES PATENT OFFICE

CERTIFICATE OF CORRECTION

Patent No. 4,065,179 Dated December 27, 1977

Inventor(s) Takao Takasaki

It is certified that error appears in the above-identified patent and that said Letters Patent are hereby corrected as shown below:

Column 3, line 23, "39a" should read -- 39b --.

Column 4, line 59, "said" (second occurrence) should read -- side -- .

Signed and Sealed this

*Sixth* Day of *June 1978*

[SEAL]

*Attest:*

RUTH C. MASON
*Attesting Officer*

DONALD W. BANNER
*Commissioner of Patents and Trademarks*